US006216373B1

(12) United States Patent
Liao

(10) Patent No.: US 6,216,373 B1
(45) Date of Patent: Apr. 17, 2001

(54) LUMINESCENT JIGSAW PICTURE

(76) Inventor: Ching-Shin Liao, No. 467, Ta-Li Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/437,486

(22) Filed: Nov. 10, 1999

(51) Int. Cl.[7] ..... G09F 13/22
(52) U.S. Cl. ..... 40/544
(58) Field of Search ..... 40/544

(56) References Cited

U.S. PATENT DOCUMENTS 5,084,309 * 1/1992 Smith et al. ..... 428/29
5,257,785 * 11/1993 Sugie ..... 40/542
5,455,749 * 10/1995 Ferber ..... 362/103

* cited by examiner

*Primary Examiner*—Michael F. Trettel
*Assistant Examiner*—Andrea Chop
(74) *Attorney, Agent, or Firm*—Bacon & Thomas

(57) ABSTRACT

A luminescent jigsaw picture or pattern mainly comprises a frame body with a plurality of conductive circuits aligned in sequence of a negative circuit comes after a positive or vice versa, wherein a wiring box and a multistage switch are disposed in the frame body for selecting and conductively jointing a pair of conductive circuits. A plurality of luminescent jigsaw pieces is attached to a translucent pattern or picture in the frame body, and under the pattern, a transparent conductive layer, a lightening layer, an insulation layer, and another conductive layer are disposed sequentially, wherein light emitted from the lightening layer permeates the translucent material to display the pattern on the outermost face to form a light picture.

6 Claims, 6 Drawing Sheets

LUMINESCENT JIGSAW PICTURE

BACKGROUND OF THE INVENTION

1. Field of the Invention

This invention relates generally to a light picture, more particularly, to a luminescent jigsaw picture or pattern serving as a light decorative article on the wall.

2. Description of the Prior Art

A decorative framed wall-picture depicting a historic or scene spot or a cartoon figure will inevitably fade its freshness out gradually in the long run, no matter how attractive its debut could be. Instead, this invention, engaged in a structural breakthrough by putting together luminescent jigsaw pieces to form a light lining with indispensable electric circuits, is to provide a light picture with diversified configurations for keeping its attractiveness.

SUMMARY OF THE INVENTION

The primary object of this invention is to arrange a plurality of luminescent jigsaw pieces to form a lining as light sources for lightening a picture or pattern thereon.

Another object of this invention is to arrange the plurality of luminescent jigsaw pieces together with commensurate conductive lines to form diversified patterns in different light configurations.

Yet another object of this invention is to present diversified colors of the luminescent jigsaw pieces.

Furthermore, the luminescent jigsaw pieces can be designed in relatively larger scale English characters or animals for serving as an advertisement signboard.

For building abovesaid structure, a plurality of conductive lines aligned in a sequence a positive wire prior to a negative or vice versa is formed in a frame body, and a wiring box and a multistage switch are disposed at a peripheral frame beam for switching operation among different circuits. When assembling, a pattern or a picture formed in a translucent material is firstly mounted in a frame, a plurality of luminescent jigsaw pieces is then laid on back of the picture or pattern at where seen fit. Under the layer of the luminescent jigsaw pieces, a transparent conductive layer, a lightening layer, and another conductive layer are introduced one after another so that lightening the pattern and changing the light position in the pattern are made possible.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
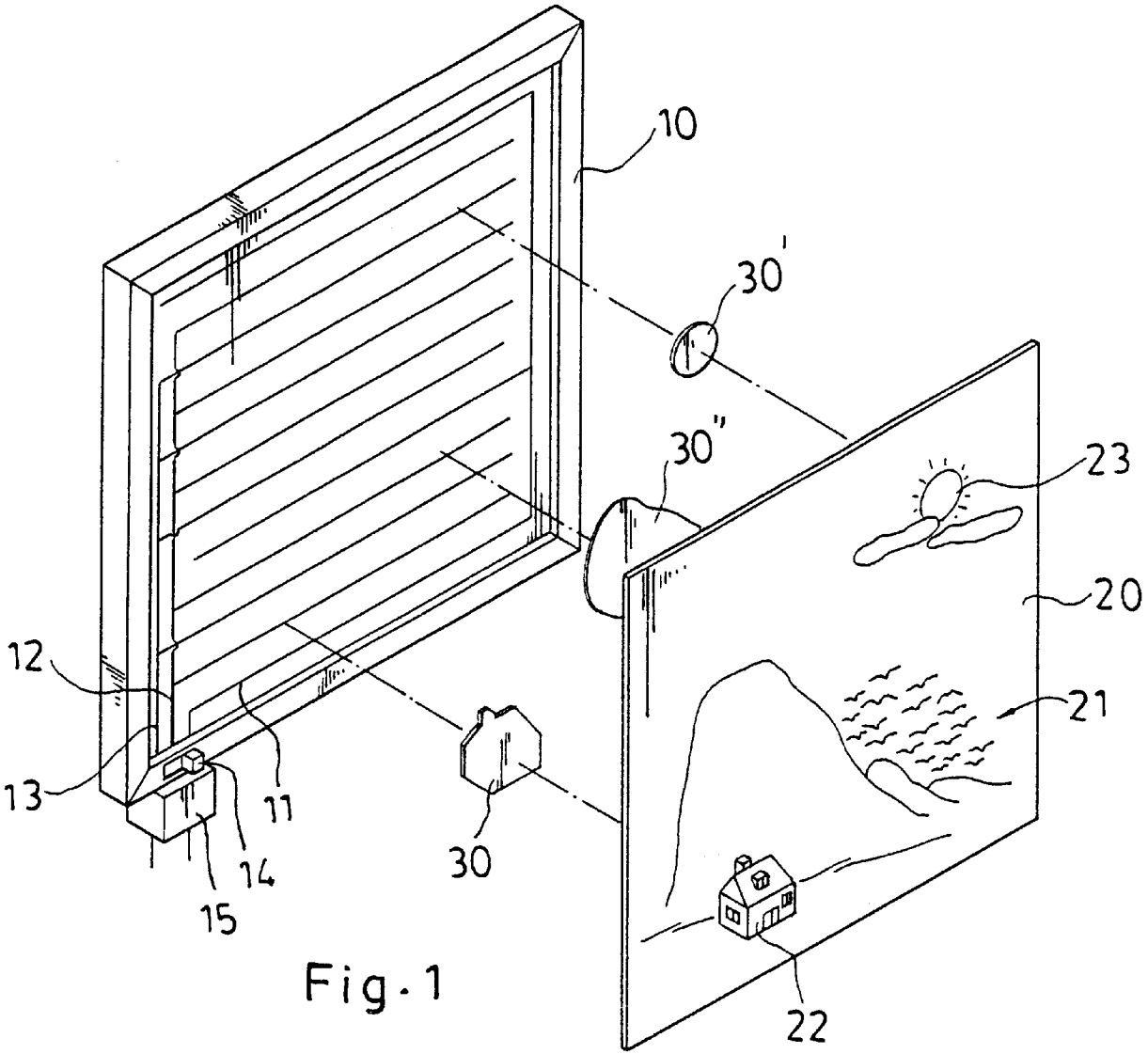
FIG. 1 is a three-dimensional exploded view of a preferred embodiment of this invention.
Figure 2:
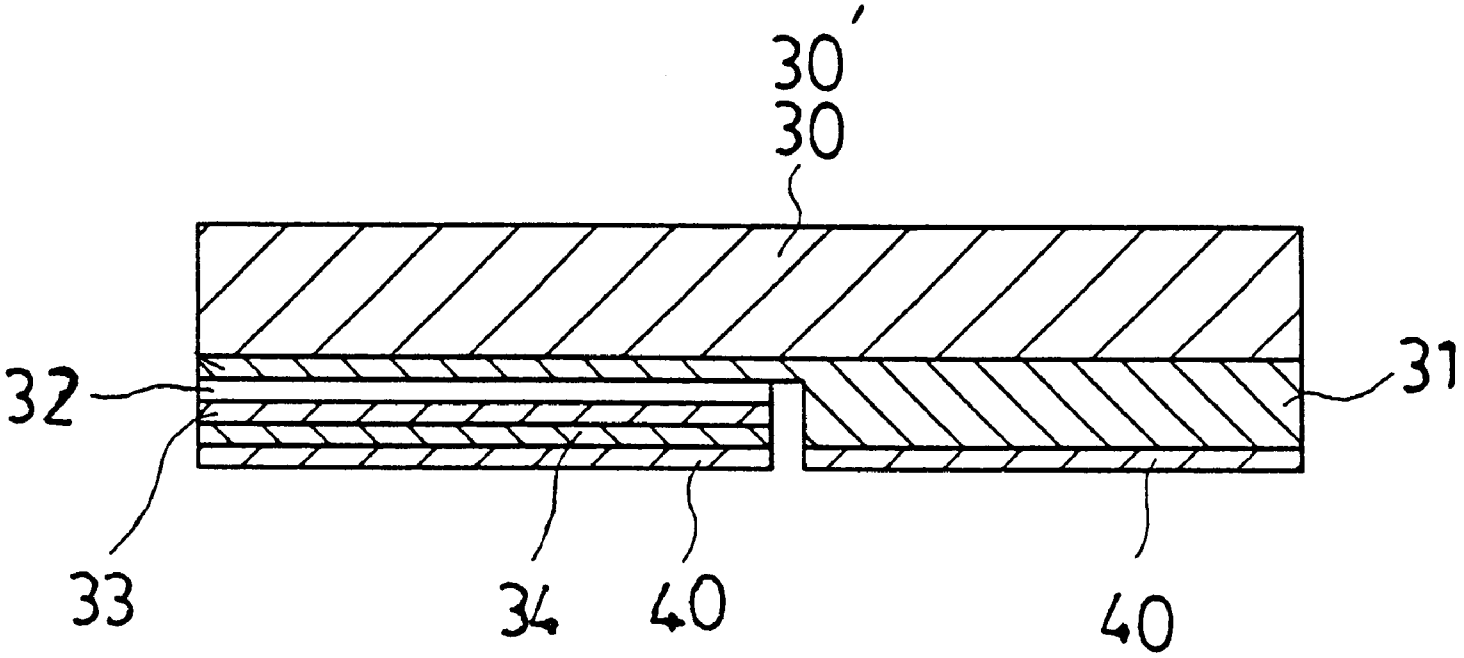
FIG. 2 is a cutaway sectional view showing a luminescent jigsaw piece in the preferred embodiment of this invention.
Figure 3:
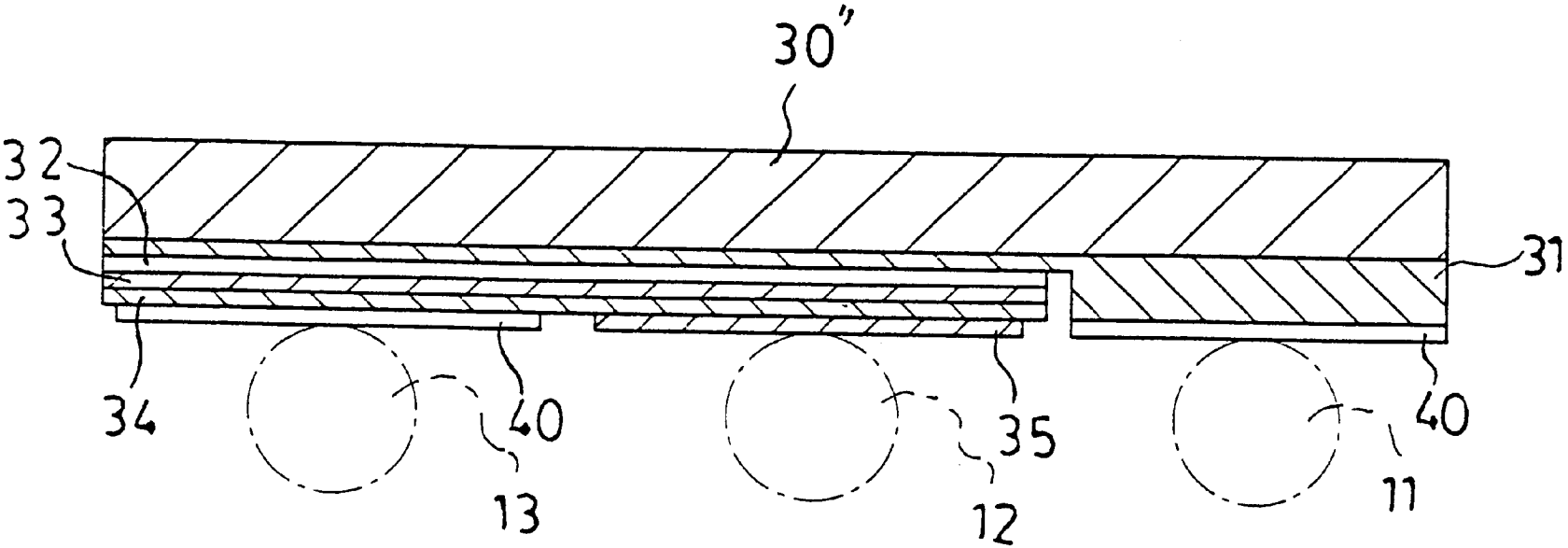
FIG. 3 is a cutaway sectional view showing a luminescent jigsaw piece in another preferred embodiment of this invention.
Figure 4:
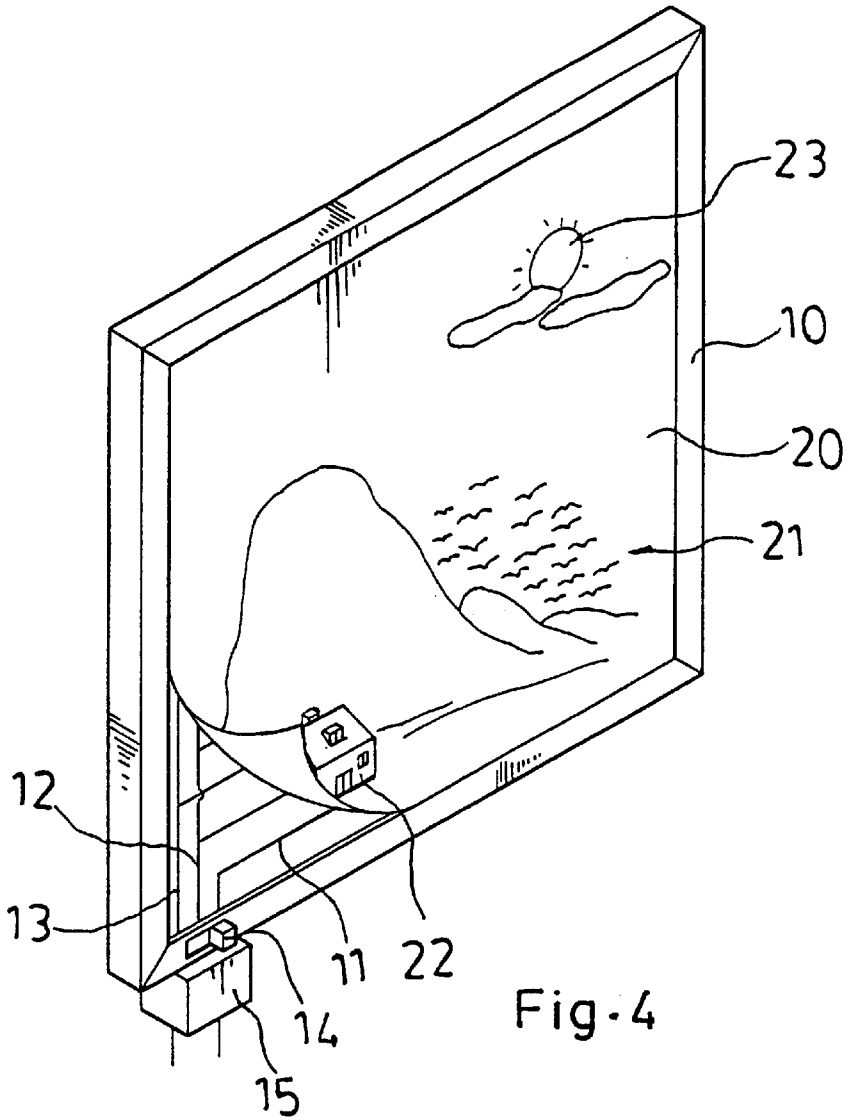
FIG. 4 is a three-dimensional view of another preferred embodiment of this invention.

As shown in FIG. 1 through FIG. 4, a printed circuit board (PCB) having a first, a second, and a third conductive circuit

11, 12, 13 in different potentials is disposed in a frame body 10. A multistage switch 14 and a wiring box 15 (shown in FIG. 1) are positioned at a peripheral beam of the frame body 10, wherein the multistage switch 14 can be switched automatically or manipulatively to conductively joint any two conductive circuits among the three.

The translucent pattern 20 in the frame body 10 may be painted or printed with a theme like a lovely landscape or animals. In the case of this invention, mountain is taken as the theme including a flock of flying birds 21, a house 22 at the mountain hill, and the sun 23 climbed up in the midst of the cloud.

Two luminescent jigsaw pieces 30, 30' are attached each to the house 22 and the sun 23 respectively and correspondingly on the pattern 20 in the frame body 10. Under the luminescent jigsaw pieces 30, 30', a transparent conductive layer 31, a lightening layer 32, an insulation layer 33, and another conductive layer 34 are sequentially attached so that the lightening layer 32 can be lightened due to a bias voltage difference existed between the transparent conductive layer 31 and the other conductive layer 34 (shown in FIG. 3).

As the flock of birds 21 obviously occupies a relatively larger area with respect to the house 22 and the sun 23, a corresponding luminescent jigsaw piece 30" in larger scale would be required (shown in FIG. 1), which may bestride three even four circuits, hence, for avoiding any possible short circuit caused by other conductive lines laying between two outer conductive lines under a luminescent jigsaw piece 30, 30' 30", a protective insulation layer 35 is adhered onto the backside of the conductive layer 34 in its middle portion.

Further, a conductive glue 40 is applied to the transparent conductive layer 31 and the other conductive layer 34 respectively, and because each luminescent jigsaw piece 30, 30', 30" bestrides two of the three circuits, therefore, the multistage switch 14 can be switched to select and lighten one of the luminescent jigsaw pieces 30, 30' 30". In other words, when the first and the second circuit 11, 12 are conductively jointed, the luminescent jigsaw piece 30 corresponding to the house 22 is lightened, and so forth.

From the above, it is known that this invention can provide extra pleasure as playing a jigsaw puzzle in addition to its prolonged lifetime by using luminescent jigsaw pieces 30, 30', 30" that can also change its lightening position controlled by the multistage switch 14. Meanwhile, a pseudo movement may be created because of vision errors that might render another kind of pleasure when viewing from other angles.

Moreover, more circuits may be added to the frame body 10 for enriching position shift of the luminescent jigsaw pieces 30, 30', 30".

Figure 5:
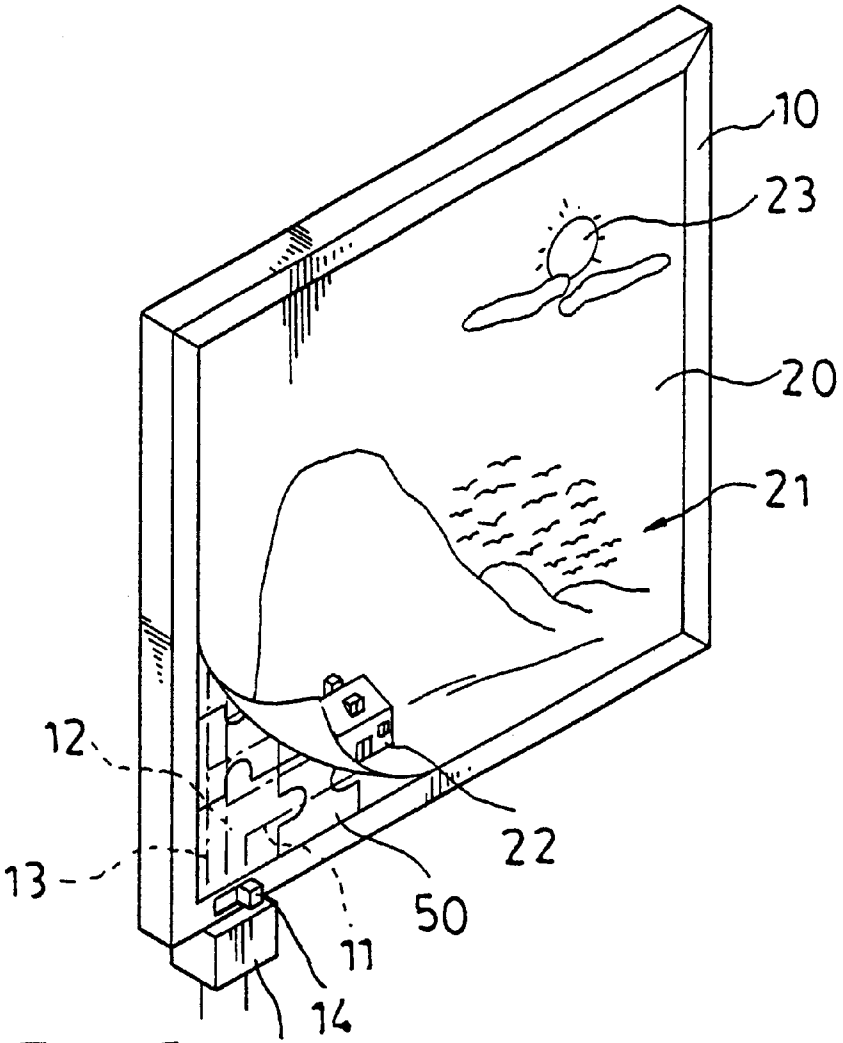
FIG. 5 is a three-dimensional view of yet another preferred embodiment of this invention.

A larger scale luminescent jigsaw piece 50 may be mounted in the frame body 10 before placing the translucent pattern 20 (shown in FIG. 5)

Figure 6:
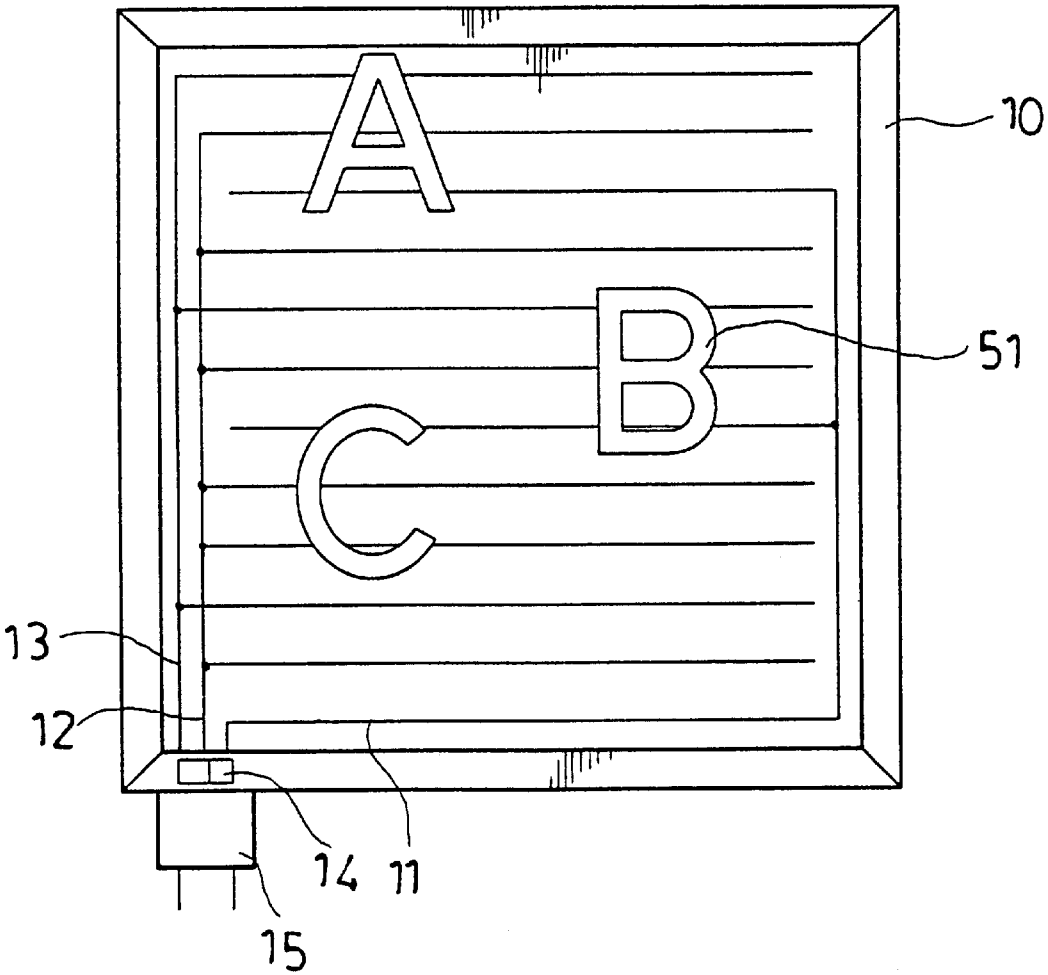
FIG. 6 is a front view of a furthermore preferred embodiment of this invention.

A luminescent jigsaw piece 51 in larger scale may be designed in English characters (shown in FIG. 6) for teaching purpose.

The luminescent jigsaw pieces 30, 30', 30", 50, and 51 may be formed in different colors for creating diversified color changes.

Although, this invention has been described in terms of preferred embodiments, it is apparent that numerous variations and modifications may be made without departing from the true spirit and scope thereof, as set forth in the following claims.

What is claimed is:

1. A luminescent jigsaw picture, comprising:

a frame body having at least two circuits disposed therein, wherein the circuits are arranged in a manner of interpolating a circuit in polarity different from two neighboring circuits, and a wiring box and a multistage switch are positioned at a peripheral beam of said frame body;

a pattern made in a translucent material covered on said frame body, said pattern being in the form of a picture; and a plurality of luminescent jigsaw pieces, each luminescent jigsaw piece coated with a layer of conductive glue being attached to a position in said frame body corresponding with a figure in said pattern to form a positive and a negative conductive line, wherein under each said luminescent jigsaw piece, a first conductive layer which is transparent, a lightening layer, an insulation layer, and a second conductive layer are sequentially attached; and in virtue of a potential difference between said first transparent conductive layer and said second conductive layer, said lightening layer can be lightened to illuminate said translucent pattern;

in accordance with abovesaid construction manner to have said luminescent jigsaw pieces laid at respective positions, all or partially, in said frame body to form a wall-paint or a wall-map, meanwhile, to have said first transparent conductive layer and said second conductive layer bestridden two different circuits so that said multistage switch can be switched to conductively joint two circuits of said at least two circuits for selectively lightening a desirable luminescent jigsaw piece of said plurality of luminescent jigsaw pieces and a corresponding figure in said pattern accordingly.

2. The luminescent jigsaw picture of claim 1, wherein a bottom picture is formed in said frame body for easy setting of said luminescent jigsaw piece in place.

3. The luminescent jigsaw picture of claim 1 which comprises at least three circuits to enrich change of lightening position.

4. The luminescent jigsaw picture of claim 1, wherein said circuits are formed by a printing method.

5. The luminescent jigsaw picture of claim 1, wherein said luminescent jigsaw piece may be designed in diversified colors.

6. The luminescent jigsaw picture of claim 1, wherein said pattern is designed in relatively larger scale English characters or animals, and for avoiding any possible short circuit caused by other conductive lines laying between two outer conductive lines of said luminescent jigsaw piece, a protective insulation layer is adhered onto a back of said second conductive layer at its middle portion.

* * * * *